US007581958B2

(12) United States Patent
Swanson et al.

(10) Patent No.: US 7,581,958 B2
(45) Date of Patent: Sep. 1, 2009

(54) HIGH VOLTAGE HEATER TERMINATION

(75) Inventors: Cal T. Swanson, Saint Louis, MO (US); Michael Stewart, Fenton, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

(21) Appl. No.: 11/591,203

(22) Filed: Nov. 1, 2006

(65) Prior Publication Data

US 2007/0184700 A1 Aug. 9, 2007

Related U.S. Application Data

(60) Provisional application No. 60/765,290, filed on Feb. 3, 2006.

(51) Int. Cl.
*H01R 12/00* (2006.01)

(52) U.S. Cl. ..... 439/63; 439/329

(58) Field of Classification Search ..... 439/63, 439/67, 329, 470, 473, 581, 585
See application file for complete search history.

(56) References Cited

U.S. PATENT DOCUMENTS 5,513,075 A * 4/1996 Capper et al. ..... 361/773
5,879,190 A * 3/1999 Maruyama et al. ..... 439/582
6,037,574 A 3/2000 Lanham et al.
6,533,610 B1 * 3/2003 Dai et al. ..... 439/581
6,607,400 B1 * 8/2003 Ko ..... 439/581
7,186,142 B2 * 3/2007 Nagata et al. ..... 439/582

FOREIGN PATENT DOCUMENTS

EP 0 566 206 10/1993
GB 632 129 11/1949

OTHER PUBLICATIONS

PCT/US2007/002826—International Search Report, Jul. 3, 2007.

* cited by examiner

*Primary Examiner*—Thanh-Tam T Le
(74) *Attorney, Agent, or Firm*—Brinks Hofer Gilson & Lione

(57) ABSTRACT

A connector assembly is provided that includes an upper element and a lower element in contact with the upper element along a contour-matched interface. The first element and the second element are dielectric and each comprise a recess and a groove, the recesses cooperatively forming a cavity and the grooves cooperatively forming a channel communicating the cavity to exterior surfaces of the upper element and the lower element. A conductive plug is disposed within the cavity and is adapted for engaging a lead wire and a terminal pad. Preferably, the connector assembly further includes a clamping device for securing the connector assembly to a substrate and a spring element disposed within the cavity, wherein the conductive plug is disposed between the terminal pad and the spring such that the spring biases the conductive plug against the terminal pad.

22 Claims, 13 Drawing Sheets

HIGH VOLTAGE HEATER TERMINATION

CROSS REFERENCE TO RELATED APPLICATIONS

This application claims the benefit of U.S. Provisional Application No. 60/765,290, filed on Feb. 3, 2006. The disclosure of the above application is incorporated herein by reference.

FIELD

The present disclosure relates generally to electric heaters, and more particularly to heater termination structures for connecting the electric heaters to power supplies.

BACKGROUND

The statements in this section merely provide background information related to the present disclosure and may not constitute prior art.

Some forms of electric heaters generally include a substrate, a resistive heating element embedded within or disposed proximate the substrate, and a protective layer disposed over the resistive heating element. The resistive heating element is commonly terminated in a pair of terminal pads, which are not covered by the protective layer, for connecting a pair of lead wires extending from a power source. The connection between the terminal pads and the lead wires is generally insulated from the outside environment to prevent against accidental discharge of the voltage applied by the power source. Conventional termination structures, however, often include numerous parts that define interfaces with enclosed air gaps. Air gaps pose serious arcing problems, particularly when the electric heater is used in a semiconductor manufacturing process, where a relatively high voltage is applied in a vacuum environment.

Generally, arcing is a result of an electrical breakdown that occurs when a voltage applied across an air gap exceeds a threshold breakdown field for the air. Under this high electric field, free electrons in the air gap produce ionizing collisions with air molecules, and thus the air gap becomes an electric current path in addition to a designated electric current path within a conductive element. Unfortunately, arcing often damages the insulation of the termination structure and may lead to malfunction of the termination structure and the overall heater.

Arcing from electrical terminations across an air gap to a conductive surface typically occurs when the electric heater is operated above 340 peak voltage and is dependent upon both the molecular density of the air and the span of the air gap over which the voltage gradient exists. Because the breakdown voltage for a typical air gap in a vacuum chamber initially decreases as the air pressure is reduced below 1 atmosphere, arcing is thus more likely to occur to or from a terminal of an energized heater during evacuation or filling. The conventional termination structure for an electric heater has proven to be especially susceptible to arcing in this vacuum environment, for example, when the electric heater is used in a semiconductor manufacturing process.

SUMMARY

In one preferred form, a connector for connecting a lead wire to a terminal pad is provided that comprises a dielectric enclosure surrounding the terminal pad and defining a cavity open to the terminal pad. The dielectric enclosure comprises an upper element and a lower element in contact with the upper element along a contour-matched interface. A conductive plug is disposed within the cavity for electrically connecting the terminal pad to the lead wire.

In another preferred form, a dielectric enclosure is provided that defines a cavity open to a first exterior surface and a channel communicating the cavity to at least one second exterior surface. The cavity and the channel provide a conduit for an electrical connection, wherein the dielectric enclosure is adapted to receive a terminal pad within the cavity proximate the first exterior surface and to receive a lead wire within the channel proximate the second exterior surface.

In yet another preferred form, a connector assembly is provided that comprises a first element and a second element in contact with the first element along a contour-matched interface. The first element and the second element each comprising a recess and a groove, the recesses cooperatively forming a cavity and the grooves cooperatively forming a channel communicating the cavity to exterior surfaces of the first element and the second element. The connector assembly further comprises a conductive plug disposed within the cavity and adapted for engaging a lead wire and a terminal pad.

In still another preferred form, a heater is provided that comprises a resistive heating element, a terminal pad connected to the resistive heating element, and a connector for connecting the terminal pad to a lead wire. The connector comprises a first element and a second element in contact with the first element along a contour-matched interface. The first element and the second element each comprise a recess and a groove, the recesses cooperatively forming a cavity and the grooves cooperatively forming a channel communicating the cavity to exterior surfaces of the first element and the second element. Additionally, a conductive plug is disposed within the cavity and adapted for engaging the lead wire and the terminal pad.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 5A:
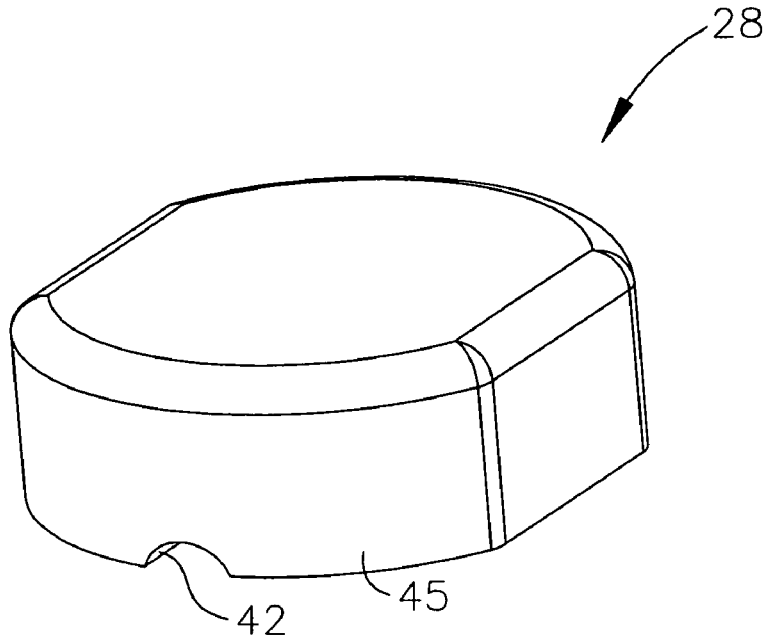
Figure 5B:
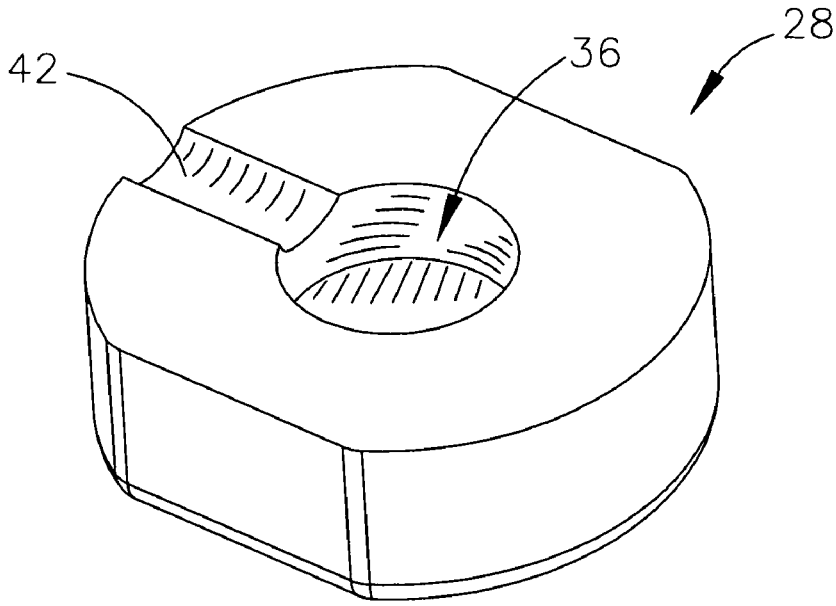
Figure 6A:
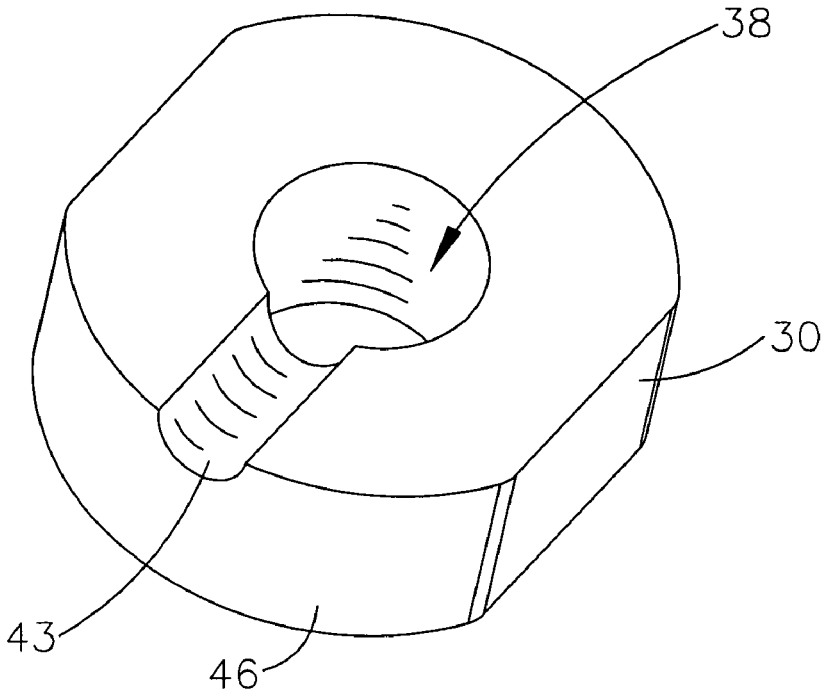
Figure 6B:
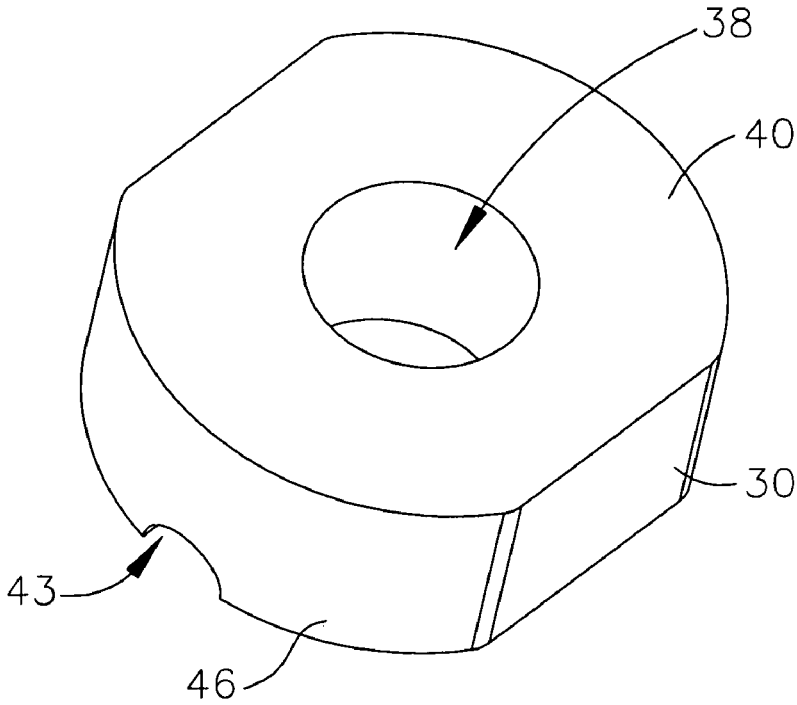
Figure 7:
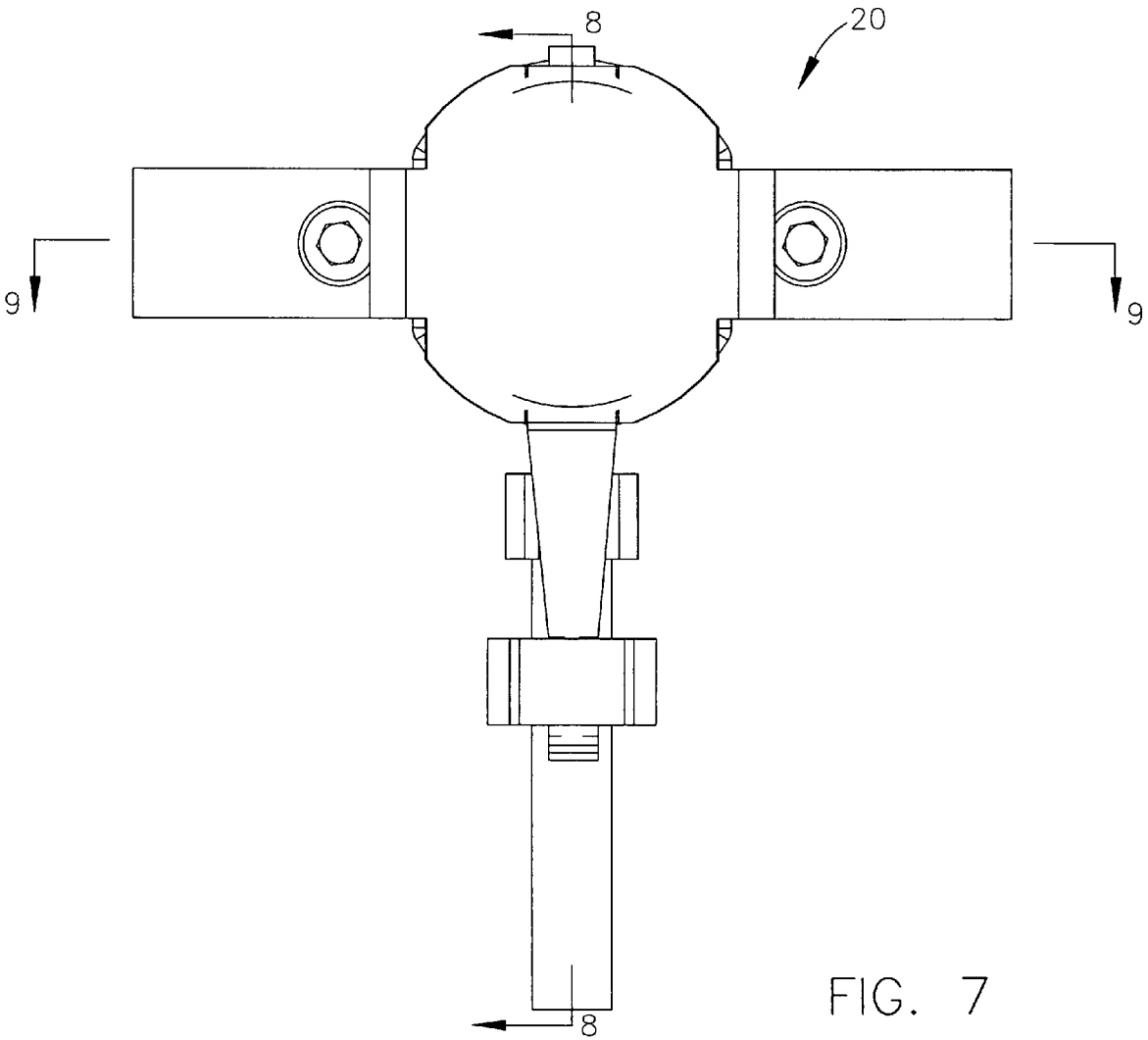
Figure 8:
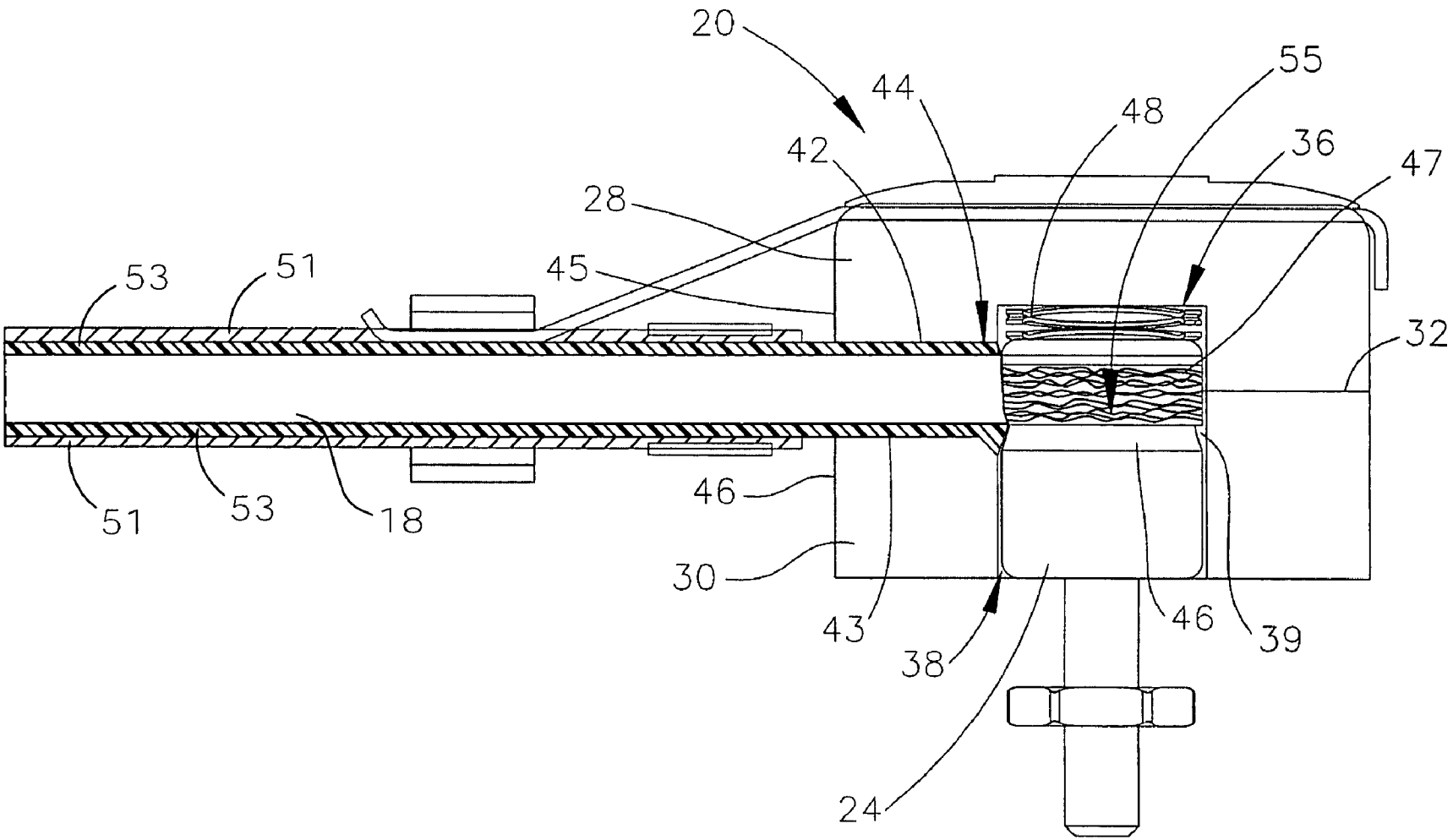
Figure 9:
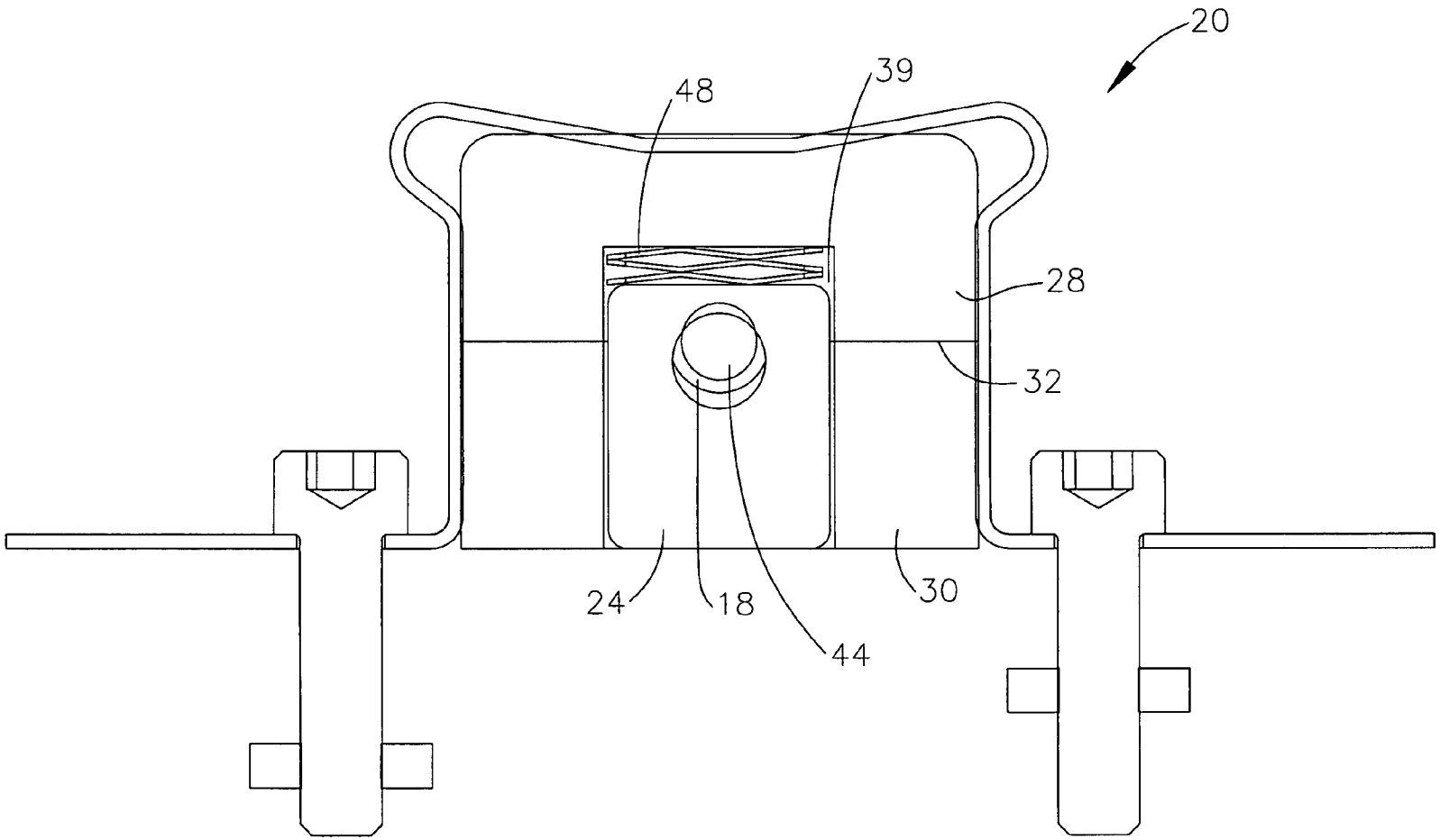
Figure 10:
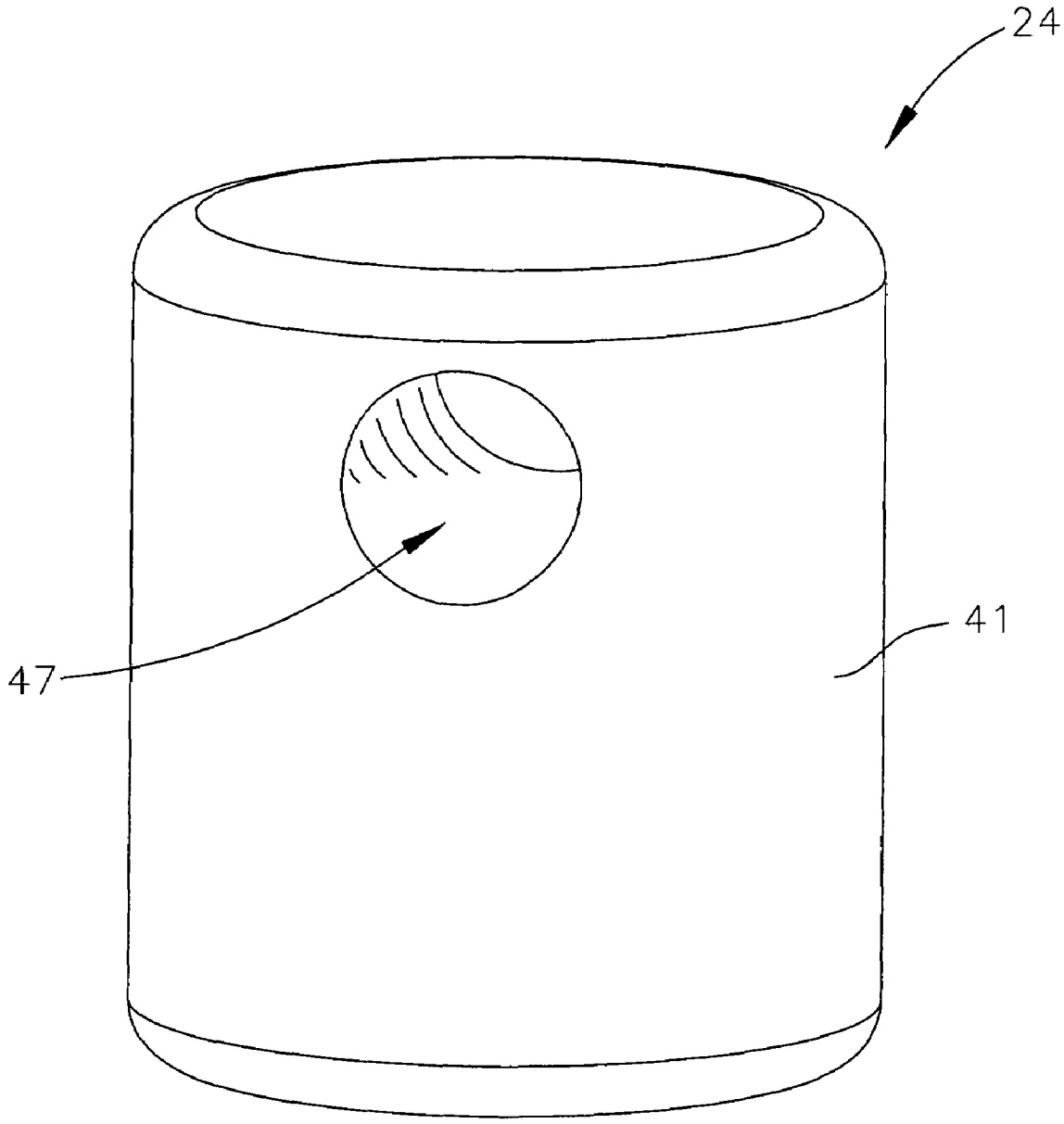
Figure 11A:
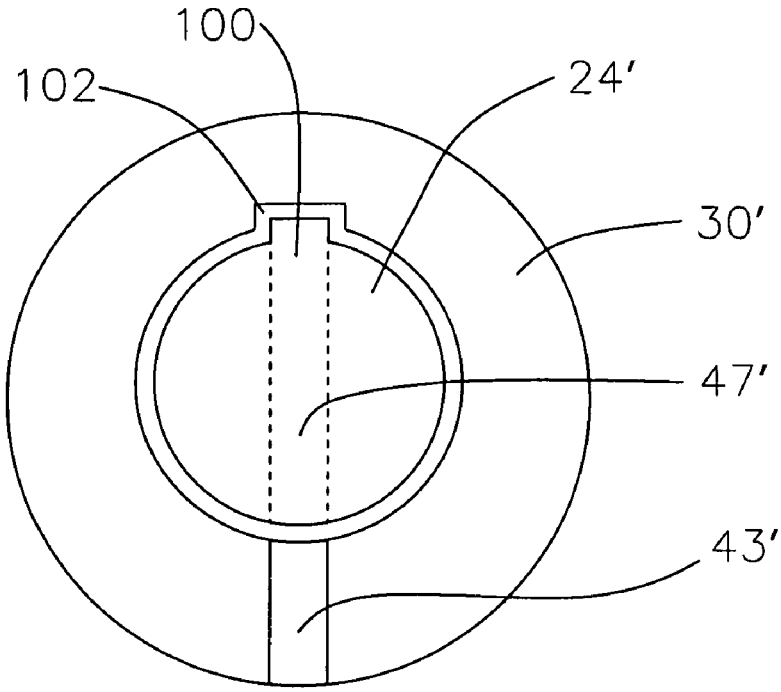
Figure 11B:
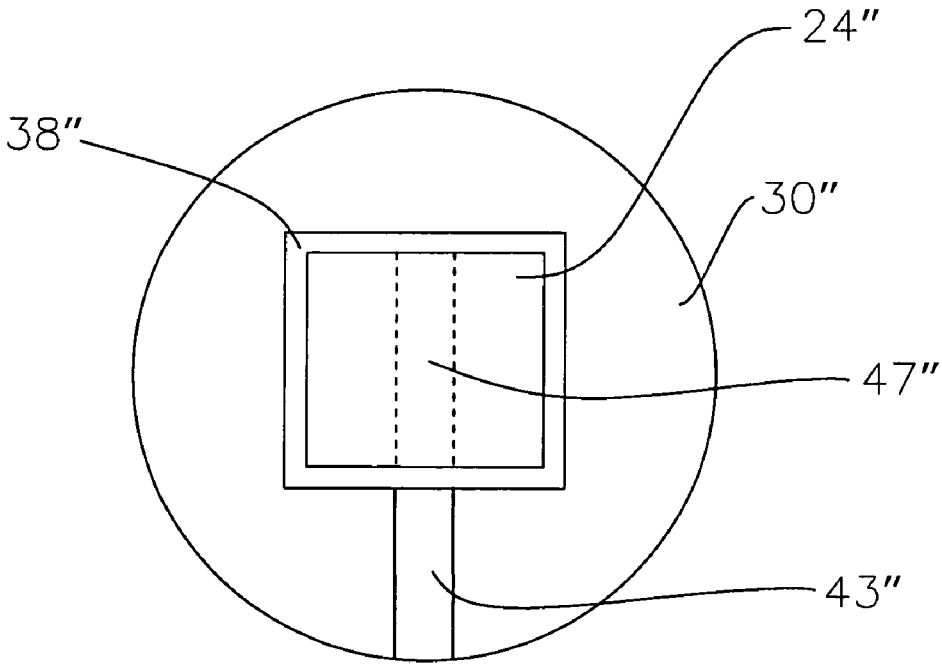
Figure 12:
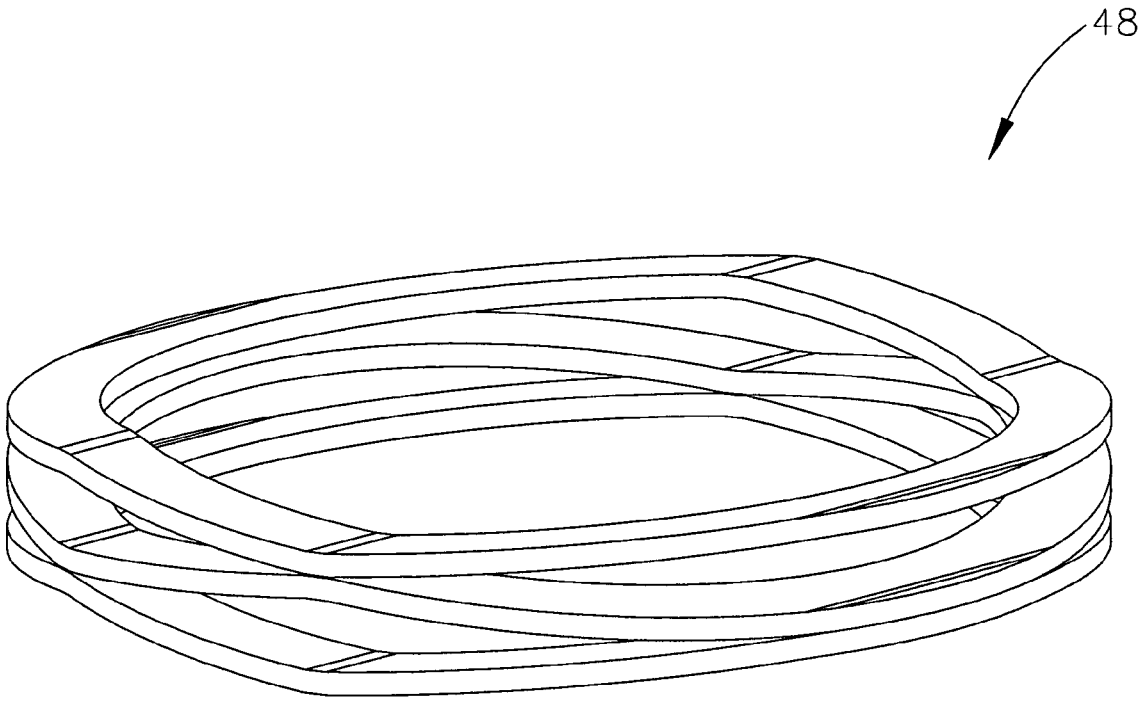
Figure 13:
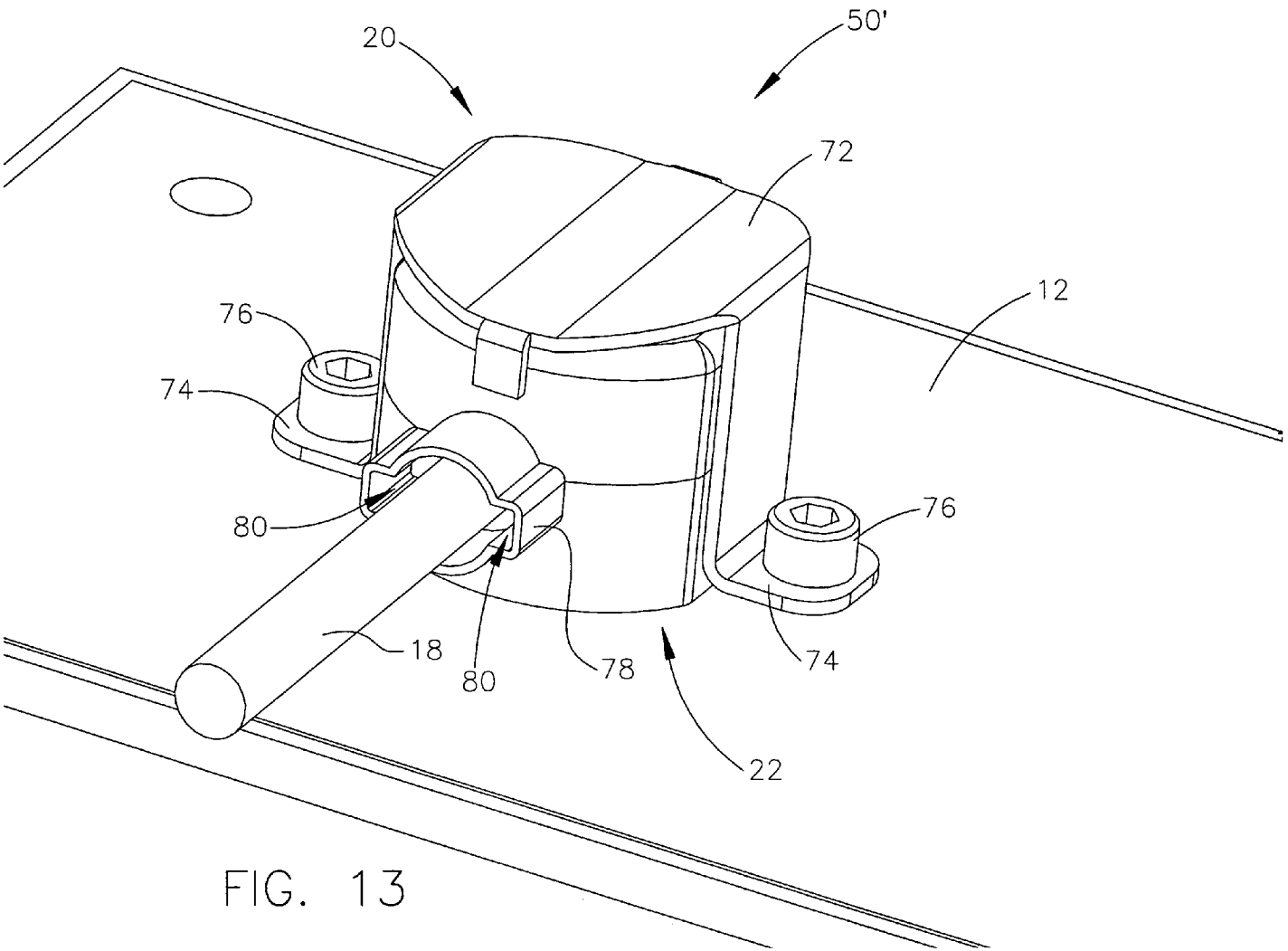

FIG. 5*a* is a perspective view of the top of an upper element of a dielectric enclosure constructed in accordance with the teachings of the present disclosure;

FIG. 5*b* is a perspective view of the bottom of the upper element of a dielectric enclosure constructed in accordance with the teachings of the present disclosure;

FIG. 6*a* is a perspective view of the top of a lower element of a dielectric enclosure constructed in accordance with the teachings of the present disclosure;

FIG. 6*b* is a perspective view of the bottom of the lower element of a dielectric enclosure constructed in accordance with the teachings of the present disclosure;

FIG. 7 is a top view of the connector assembly in accordance with the teachings of the present disclosure;

FIG. 8 is a cross-sectional view, taken along line 8-8 of FIG. 7, of the connector assembly in accordance with the teachings of the present disclosure;

FIG. 9 is a cross-sectional view, taken along line 9-9 of FIG. 7, of the connector assembly in accordance with the teachings of the present disclosure;

FIG. 10 is a perspective view of a conductive plug constructed in accordance with the teachings of the present disclosure;

FIG. 11*a* is a top view of an alternate embodiment of the conductive plug having an alignment feature and constructed in accordance with the teachings of the present disclosure;

FIG. 11*b* is a top view of another alternate embodiment of the conductive plug having an alignment feature and constructed in accordance with the teachings of the present disclosure;

FIG. 12 is a perspective view of a spring constructed in accordance with the teachings of the present disclosure; and FIG. 13 is a perspective view of an alternate form of a clamping device constructed in accordance with the teachings of the present disclosure.

Corresponding reference numerals indicate corresponding parts throughout the several views of the drawings.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
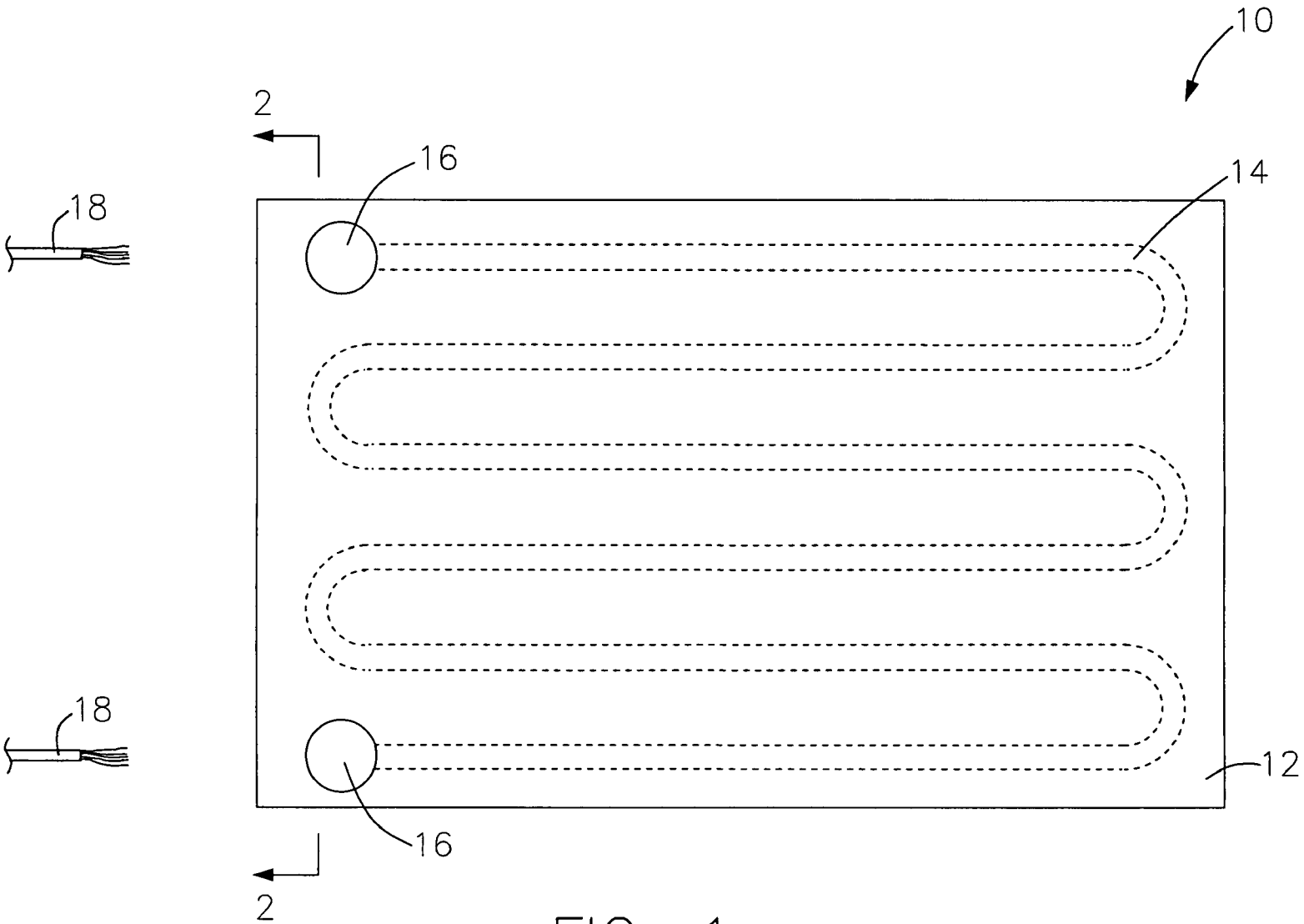
FIG. 1 is a top view of a substrate having a resistive heating element and terminal pads connected to the resistive heating element in accordance with the teachings of the present disclosure.
Figure 2:
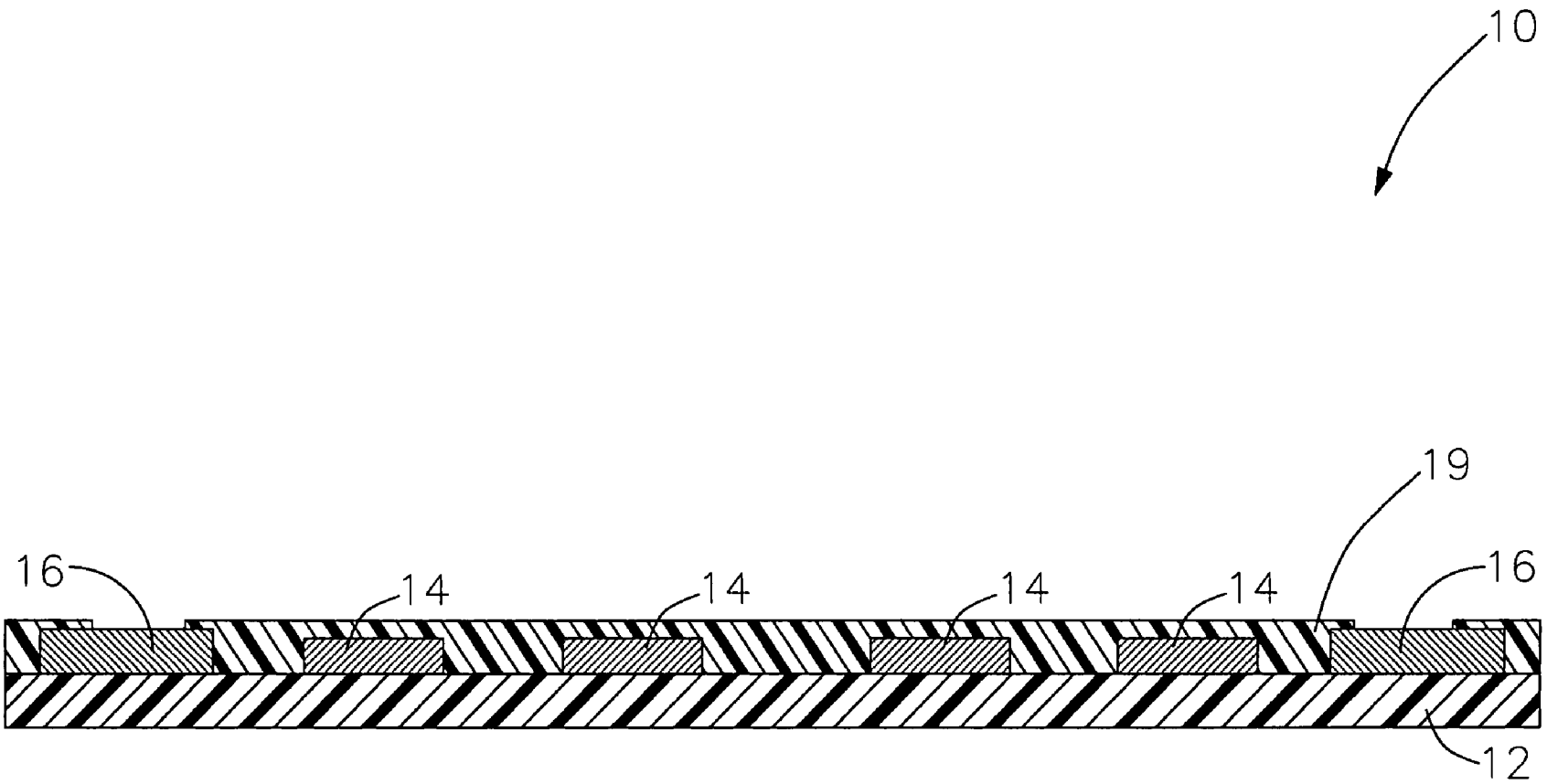
FIG. 2 is a cross sectional view, taken along line 2-2 of FIG. 1, illustrating terminal pads in greater detail in accordance with the teachings of the present disclosure.

Referring to FIGS. 1 and 2, a heater constructed in accordance with the teachings of the present disclosure is illustrated and generally indicated by reference numeral 10. The heater 10 includes a substrate 12, a resistive heating element 14 disposed on the substrate 12, and a pair of terminal pads 16 for connecting the resistive heating element 14 to a pair of lead wires 18. A protective layer 19 is preferably disposed over the resistive heating element 14 for insulation and protection from the outside environment. The resistive heating element 14 can be, by way of example, a resistive wire or a resistive film, among others. One example of such a film resistive heating element 14 is disclosed in U.S. Pat. No. 6,037,574, titled "Quartz Substrate Heater," which is commonly assigned with the present application and the contents of which are incorporated by reference herein in their entirety.

Figure 3:
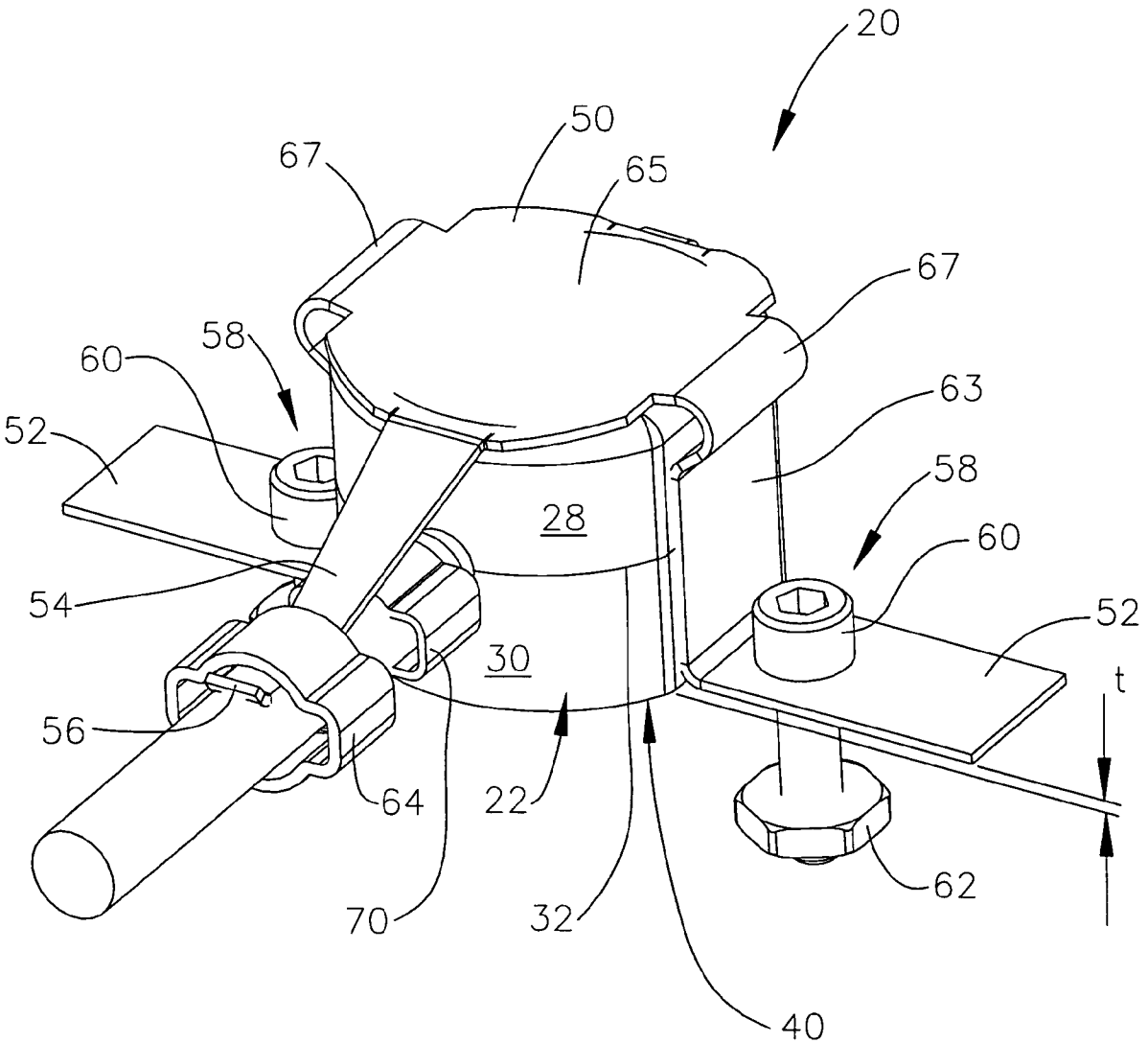
FIG. 3 is a perspective view of a connector assembly constructed in accordance with the teachings of the present disclosure.
Figure 4:
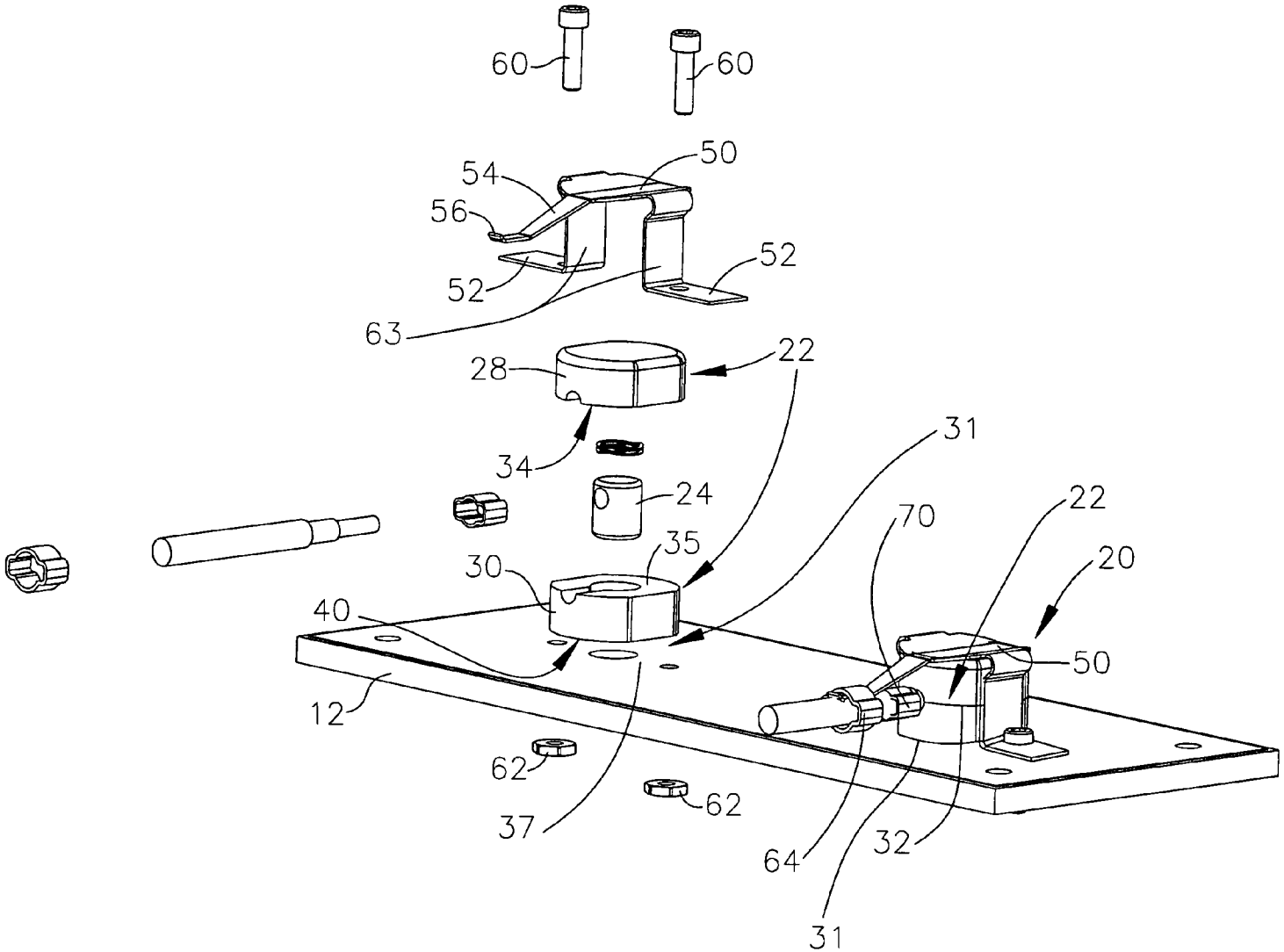
FIG. 4 is a perspective view illustrating an exploded connector assembly and a second, assembled, connector assembly constructed in accordance with the teachings of the present disclosure.

Referring now to FIGS. 3 and 4, a connector assembly in accordance with one form of the present disclosure is illustrated and generally indicated by reference numeral 20. Generally, the connector assembly 20 (also referred to herein as a "connector") is adapted for placement onto the substrate 12 or a heater 10, and more specifically onto the protective layer 19 and over the terminal pads 16, for securing and protecting the connection between the terminal pads 16 and the lead wires 18 as previously illustrated and described.

The connector assembly 20 generally includes a dielectric enclosure 22 and a conductive plug 24 disposed therein. As shown, the dielectric enclosure 22 includes an upper element 28 and a lower element 30, wherein the lower element 30 is in contact with the upper element 28 along a contour-matched interface 32. The contour-matched interface 32 is preferably defined by contact surfaces 34 and 35, of the upper element 28 and lower element 30 respectively, which are substantially flat in the illustrated embodiment and in intimate contact with each other. As used herein, the term "contour-matched-"should be construed to mean that the mating surfaces of the upper element 28 and the lower element 30 are matched, or their mating surface geometry is substantially identical, such that intimate contact between the upper element 28 and the lower element 30 is achieved. Additionally, the term "contour-matched" shall be construed to include mating surface geometry that is not only flat as illustrated herein, but mating surface geometry that is otherwise curved, flat, and/or a combination of curved and flat. Moreover, the mating surfaces may be oriented other than as shown with the upper element 28 and the lower element 30, for example, with a vertical or angled orientation rather than the relatively horizontal orientation as shown and described. As such, the dielectric enclosure 22 could alternately comprise any number of elements in a variety of orientations rather than the two (2) elements (upper element 28 and lower element 30) as shown and described. Such alternate elements are hereinafter referred to as a "first element," a "second element," a "third element," and so on. It should be understood that such variations are within the scope of the present disclosure.

As shown in FIG. 4, the lower element 30 and the heater 10 also define a contour-matched interface 31. As such, the lower element 30 defines a lower contact surface 40, and the heater 10 defines a contact surface area 37 (shown dashed) on the surface of the protective layer 19. Therefore, the lower contact surface 40 of the lower element and the contact surface area 37 of the heater 10 are in intimate contact as with the upper element 28 and the lower element 30. Such intimate contact, or contour-matched interface, reduces the possibility of air gaps being present in the overall connector assembly 20 and thus reduces the likelihood of undesirable arcing. To further achieve the contour-matched interfaces as described herein, in one form of the disclosure, the profile tolerances for the surfaces defining the contour-matched interfaces is approximately ±0.001 inches (±0.00254 cm). Such tolerances are exemplary only and should not be construed as limiting the scope of the present invention.

Referring to FIGS. 5*a* and 5*b*, the upper element 28 further comprises a recess 36, preferably in the form of a blind hole as shown, for receiving the conductive plug 24. Additionally, the upper element defines a groove 42 that is adapted to receive a lead wire 18. Similarly, as illustrated in greater detail in FIGS. 6*a* and 6*b*, the lower element 30 comprises a recess 38, preferably in the form of a through hole, which is open to the lower contact surface 40 of the lower element 30. The lower contact surface 40 is adapted for contact with the protective layer 19 as previously described, and the recess 38 provides access for the conductive plug 24 to contact the terminal pad 16, which is described in greater detail below. As further shown, the lower element 30 also comprises a groove 43 that is adapted to receive a lead wire 18, the details of which are described in greater detail below.

Referring now to FIGS. 7 through 9, the recess 36 of the upper element 28 and the recess 38 of the lower element 30 are so configured that they cooperatively define a cavity 39 adapted to receive the conductive plug 24 therein. Additionally, grooves 42 and 43 of the upper element 28 and the lower element 30, respectively, cooperatively form a channel 44 for insertion of the lead wire 18. As shown, the grooves 42 and 43 extend from the cavity 39 to exterior surfaces 45 and 46 of the dielectric enclosure 22 in order to receive the external lead wire 18.

As shown in greater detail in FIG. 8, the lead wire 18 comprises an outer metal or protective sheath 51 and an inner insulating sheath 53 that surrounds the individual wire strands 55. Preferably, the outer protective sheath 51 is removed such that the inner insulating sheath 53 is disposed within and is in contact with the channel 44. Accordingly, the interface between the lead wire 18 and the channel 44 is such that the inner insulating sheath 53 of the lead wire 18 is compressed and thus completely fills the channel 44 along at least a portion thereof to interrupt the air gap from the cavity 39 to the exterior of the dielectric enclosure 20. The metal or protective sheath 51 and the inner insulating sheath 53 surround and protect the wire strands 55 along the length of the lead wire 18, except for the portion to be inserted into the receptacle 47 of the conductive plug 24, which establishes an electrical connection between the conductive plug 24 and the lead wire 18. As such, the insulating sheath 53 provides an additional barrier against air gaps and thus aids in reducing the possibility of undesirable arcing. Additionally, the inner insulating sheath 53 is preferably a ceramic fiber material such as Nextel®. The metal or protective sheath 51 is preferably a metallic braid such as nickel, which maintains the inner insulating sheath 53, provides mechanical armor, withstands high temperatures, and also provides an electrical ground reference. Generally, the effectiveness of the connector assembly 20 requires wire with an electrical rating equal to or greater than the voltages and currents intended for the connector assembly 20.

As further shown, the receptacle 47 of the conductive plug 24 is disposed adjacent to the channel 44 of the dielectric enclosure 22 and is in communication therewith. When the conductive plug 24 is placed within the cavity 39, the conductive plug 24 is disposed immediately above and in contact with the terminal pad 16 (not shown), with the receptacle 47 aligned with the channel 44. Therefore, when the lead wire 18 is disposed within the channel 44 of the dielectric enclosure 22 and into the receptacle 47 of the conductive plug 24, an electrical connection is established between the lead wire 18 and the terminal pad 16. Accordingly, the conductive plug 24 is preferably made of nickel or any other electrically conductive material that can withstand the relatively high currents and resulting temperatures.

The dielectric enclosure 22 is preferably made of a ceramic material such as, by way of example, alumina or steatite. However, it should be understood that dielectric materials other than those specifically identified herein shall be construed as falling within the scope of the present disclosure so long as they provide the proper level of insulation and protection for the connector assembly 20. Alternatively, the dielectric enclosure 22 may be made of any dielectric material other than alumina or steatite with a coating of alumina or steatite. (Do we need a figure showing the coating?)

As shown in greater detail in FIG. 10, the conductive plug 24 preferably defines a cylindrical shape and comprises a receptacle 47 formed through an external wall 41 for receiving the lead wire 18. Although the receptacle 47 is illustrated in the form of a through hole, it should be understood that a blind hole or other geometrical shape that is adapted to properly receive the lead wire 18 shall be construed to be within the scope of the present disclosure. In one form, the conductive plug 24 preferably comprises a dimple 49 formed on its upper surface 61, which is formed after the lead wire 18 is inserted into the receptacle 47 in order to firmly secure the lead wire 18 within the receptacle 47.

As shown in FIGS. 11*a* and 11*b*, each of the conductive plug 24 and the lower element 30 may define a shape, or an alignment feature, that provides alignment of the receptacle 47 of the conductive plug 24 with the channel 44 of the dielectric enclosure 22. (The upper element 28 is not shown for purposes of clarity). The conductive plug 24' in one form comprises a key 100 that engages a slot 102 formed in the lower element 30' as illustrated in FIG. 11*a*. As shown in FIG. 11*b*, the conductive plug 24" alternately defines a square geometry that fits within a square recess 38" of the lower element 30". It should be understood that the embodiments illustrated herein for improved alignment are exemplary only and should not be construed as limiting the scope of the present invention. Other geometries that provide improved alignment of the conductive plug 24 may also be employed while remaining within the scope of the present invention. Additionally, the alignment features as illustrated and described herein may or may not extend all the way to the bottom surface 40 (not shown) of the lower element 30, such that the footprint of the conductive plug 24 against the terminal pad 16 (not shown) can take on a different shape other than the key or the square.

To ensure close contact between the terminal pad 16 and the conductive plug 24, a spring element 48 is preferably disposed within the recess 36 of the upper element 28 with the conductive plug 24 disposed between the terminal pad 16 and the spring 48. The spring element 48 exerts a biasing force against the conductive plug 24 and presses the conductive plug 24 against the terminal pad 16. Preferably, the spring element 48 is made of a spring tempered nickel or iron alloy such as Inconel® X-750 or A286 that is consistent with operational temperatures of the connector.

As shown in FIG. 12, the spring 48 is preferably a "wave" spring due to its advantageous spring force over a relatively short distance. However, other types of springs may be employed while remaining within the scope of the present disclosure so long as the spring is relatively small to fit within the recess 36 and has a relatively low aspect ratio (height to diameter).

Referring back to FIGS. 3 and 4, a clamping device 50 is provided over the dielectric enclosure 22 to clamp the upper element 28 against the lower element 30, to clamp the inner insulating sheath 53 within the channel 44, and also to firmly secure the connector assembly 20 to the substrate 12. The clamping device 50 comprises opposing flanges 52 and an extension 54 defining a distal tab 56. The opposing flanges 52 are adapted to receive fasteners 58, which secure the clamping device 50 to the substrate 12. Although mechanical bolts 60 and nuts 62 are illustrated in one form of the present disclosure, it should be understood that other types of fasteners, furthermore not limited to mechanical, shall be construed as falling within the scope of the present disclosure. Additionally, any number of flanges 52 may also be employed while remaining within the scope of the present disclosure.

The distal tab 56 of the extension 54 is adapted for engagement with a first clamp 64 that is secured around the lead wire 18 as shown. Accordingly, the extension 54 provides additional stability proximate the connection between the lead wire 18 and the dielectric enclosure 22 to act as a strain relief.

As further shown, a second clamp 70 is disposed around the lead wire 18 proximate the dielectric enclosure 22. The clamp 70 compresses the sheathing around the lead wire 18 to terminate the metal or protective sheath 51 and to allow the inner insulating sheath 53 and the individual wire strands 55 to pass from the outside environment through the dielectric enclosure 22. Accordingly, the relatively high voltage present in the wire strands 55 and passing through the dielectric enclosure 22 remains insulated without direct air gap to ground potentials existing on the metal or protective sheath 51 and outside the connector assembly 20.

The clamping device 50 also comprises side walls 63 between the flanges 52 and an upper surface 65 as shown. At the intersection of the side walls 63 and the upper surface 65, the clamping device 50 further comprises ears 67, which are configured to allow for vertical displacement of the flanges 52 when the clamping device 50 is secured to the substrate 12. More specifically, the nominal position of the flanges 52 is slightly higher than the nominal position of the lower contact surface 40 of the lower element 30 when the dielectric enclosure 22 is positioned under the clamping device 50. In other words, the overall height of the dielectric enclosure 22 is slightly higher than the overall height of the clamping device 50. The slightly higher position of the flanges 52 is shown as dimension "t" for purposes of illustration. As a result, when the fasteners 58 are tightened through the substrate 12, the upper surface 65 of the clamping device 50 engages the dielectric enclosure 22, and the ears 67 flex and thus allow the side walls 63 and the flanges 52 to be vertically displaced. Accordingly, an advantageous clamping load is provided to the dielectric enclosure 22 and the substrate 12, thus maintaining intimate contact between all contour-matched surfaces, between the lead wire 18 and the receptacle 47, and providing sufficient clamping force to overcome the spring forces holding the conductive plug 24 to the termination pad 16.

In an alternate form as shown in FIG. 13, the clamping device 50' defines a U-shape member 72, which also defines opposing flanges 74. Similarly, the opposing flanges 74 are adapted to receive fasteners 76, which secure the clamping device 50' to the substrate 12. A clamp 78, which also compresses the sheathing around the lead wire 18 to terminate the wire strands 55 at the dielectric enclosure 22, defines loops 80 as shown. The loops 80 are adapted to receive wires (not shown), which extend through the loops 80 and also through the fasteners 76. Accordingly, the wires secure the lead wire 18 to the overall connector assembly 20, and the clamping device 50' secures the connector assembly 20 to the substrate 12.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A connector for connecting a lead wire to a terminal pad, the terminal pad being secured to an external substrate, the connector comprising:

a dielectric enclosure surrounding the terminal pad and defining a cavity open to the terminal pad, the dielectric enclosure comprising:

an upper element; and a lower element in contact with the upper element along a contour-matched interface;

a spring element disposed within the cavity of the dielectric enclosure; and a conductive plug disposed within the cavity for electrically connecting the terminal pad to the lead wire, wherein the conductive plug is disposed between the terminal pad and the spring such that the spring biases the conductive plug against the terminal pad.

2. The connector according to claim 1, wherein the dielectric enclosure further comprises a channel extending between the cavity and an exterior surface of the dielectric enclosure for receiving the lead wire.

3. The connector according to claim 1, wherein each of the upper element and the lower element defines a recess, the recesses of the upper and the lower elements forming the cavity.

4. The connector according to claim 3, wherein the recess of the upper element defines a blind hole.

5. The connector according to claim 3, wherein the recess of the lower element defines a through hole.

6. The connector according to claim 3, wherein the dielectric enclosure further comprises opposing grooves between the upper element and the lower element, the opposing grooves extending from the recesses to exterior surfaces of the upper and lower elements, the opposing grooves cooperatively forming a channel for receiving the lead wire.

7. The connector according to claim 6, wherein the lead wire includes wire strands and an insulating sheath around the wire strands, the insulating sheath in contact with the channel.

8. The connector according to claim 1 further comprising a clamping device for securing the connector to a substrate.

9. The connector according to claim 8, wherein the clamping device further comprises an extension adapted for being secured to the lead wire and opposing flanges adapted for being secured to the substrate.

10. The connector according to claim 8, wherein the clamping device further comprises ears that flex to provide vertical displacement.

11. The connector according to claim 8, further comprising a U-shape member mounted over the dielectric enclosure and configured to accommodate a dimensional variation of the dielectric enclosure in a direction vertical the substrate.

12. The connector according to claim 11, wherein the U-shape member applies a force against the dielectric enclosure to hold the dielectric enclosure against the substrate.

13. The connector according to claim 1, wherein the conductive plug defines a receptacle for receiving the lead wire.

14. The connector according to claim 13, wherein the conductive plug further comprises a dimple for clamping the lead wire within the receptacle.

15. The connector according to claim 13, wherein the conductive plug is made of a material selected from the group consisting of a stainless steel and a high temperature alloy.

16. The connector according to claim 1, wherein the dielectric enclosure is made of a dielectric material selected from the group consisting of alumina and steatite.

17. A connector assembly comprising:

a first element;

a second element in contact with the first element along a contour-matched interface, the first element and the second element each comprising a recess and a groove, the recesses cooperatively forming a cavity and the grooves cooperatively forming a channel communicating the cavity to exterior surfaces of the first element and the second element;

a spring element disposed within the cavity; and a conductive plug disposed within the cavity and adapted for engaging a lead wire and a terminal pad, wherein the conductive plug is disposed between the terminal pad and the spring such that the spring biases the conductive plug against the terminal pad.

18. The connector assembly according to claim 17 further comprising a clamping device for securing the connector assembly to a substrate.

19. The connector assembly according to claim 17, wherein the conductive plug defines a receptacle for receiving the lead wire.

20. The connector assembly according to claim 19, wherein the conductive plug further comprises a dimple for clamping the lead wire within the receptacle.

21. The connector assembly according to claim 17, wherein at least one of the second element and the conductive plug define an alignment feature to align the conductive plug within the cavity for receiving the lead wire.

22. The connector assembly according to claim 17 further comprising a lead wire, the lead wire comprising an outer protective sheath, an inner insulating sheath disposed within the outer protective sheath, and individual wire strands within the inner insulating sheath, wherein the inner insulating sheath is clamped within the channel of the upper element and the lower element.

* * * * *